US006890313B2

(12) United States Patent
Kim

(10) Patent No.: US 6,890,313 B2
(45) Date of Patent: May 10, 2005

(54) LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 114 days.

(21) Appl. No.: 10/448,844

(22) Filed: May 30, 2003

(65) Prior Publication Data

US 2004/0243032 A1 Dec. 2, 2004

(51) Int. Cl.[7] ..... A61H 7/00; A61H 15/00

(52) U.S. Cl. ..... 601/18; 601/19; 601/98; 601/99; 601/103; 601/116

(58) Field of Search ..... 601/15, 18, 19, 601/86, 87, 90, 92, 94, 95, 98–103, 115, 116, 118, 122, 126; 606/240–242; 607/100; 5/617, 618

(56) References Cited

U.S. PATENT DOCUMENTS

| | | | | |
|---|---|---|---|---|
| 2,193,882 | A | | 3/1940 | Petersen |
| 2,310,106 | A | | 2/1943 | Miller |
| 2,359,933 | A | | 10/1944 | Niblack |
| 2,781,040 | A | | 2/1957 | Hill |
| 2,874,689 | A | | 2/1959 | Gavelek |
| 2,909,173 | A | | 10/1959 | Anderson |
| 3,687,133 | A | | 8/1972 | Grubelic |
| 3,877,422 | A | | 4/1975 | Heuser et al. |
| 4,190,043 | A | | 2/1980 | Thompson |
| 4,422,449 | A | | 12/1983 | Hamabe |
| 4,458,675 | A | | 7/1984 | Nakao et al. |
| 4,586,493 | A | | 5/1986 | Goodman |
| 4,656,998 | A | | 4/1987 | Masuda et al. |
| 4,899,403 | A | | 2/1990 | Yamasaki |
| 4,947,833 | A | | 8/1990 | Yamasaki |
| 5,038,757 | A | | 8/1991 | Yamasaki |
| 5,088,475 | A | | 2/1992 | Steffensmeier |
| 5,165,390 | A | | 11/1992 | Fleetwood |
| 5,179,940 | A | | 1/1993 | Barreiro |
| 5,755,677 | A | | 5/1998 | Masuda et al. |
| 5,807,288 | A | | 9/1998 | Wu |
| 6,071,252 | A | | 6/2000 | Marcantoni |
| 6,190,338 | B1 | * | 2/2001 | Arndt ..... 601/115 |
| 6,224,563 | B1 | | 5/2001 | Nonoue et al. |
| 6,243,609 | B1 | | 6/2001 | Lee |
| 6,409,689 | B1 | | 6/2002 | Chen |
| 6,454,732 | B1 | | 9/2002 | Lee |
| 6,542,779 | B1 | | 4/2003 | Lee |
| 6,555,798 | B1 | | 4/2003 | Lee |
| 6,629,939 | B2 | | 10/2003 | Jikiba |
| 6,643,551 | B1 | | 11/2003 | Park |
| 6,656,138 | B2 | * | 12/2003 | Kim ..... 601/19 |
| 2002/0138023 | A1 | | 9/2002 | Kume et al. |
| 2002/0193713 | A1 | | 12/2002 | Lee |
| 2003/0018284 | A1 | | 1/2003 | Lim |

* cited by examiner

*Primary Examiner*—Danton D. DeMille
*Assistant Examiner*—Quang D. Thanh
(74) *Attorney, Agent, or Firm*—Park & Sutton LLP; John K. Park

(57) ABSTRACT

A lie-down massager includes a base frame having an elongated top panel, through which an elongated top opening is formed centrally and lengthwise, a rider, a guide member movably engaged between the base frame and the rider so as to enable the rider to make a horizontally reciprocal movement, massage bumps that move vertically and horizontally along the top opening, and a lifter that holds the massage bumps and adjusts the height of the massage bumps. The lifter includes a top member, a bottom member, a screw shaft and a motor. The screw shaft engages with a nut block and the nut block is connected with the top member by two links so that rotation of the screw shaft is converted into horizontal movement of the nut block, and the horizontal movement of the nut block is converted into vertical movement of the top member.

21 Claims, 10 Drawing Sheets

LIE-DOWN MASSAGER

BACKGROUND OF THE INVENTION

The invention relates generally to a massaging device. More particularly, the present invention relates to an improved lie-down massager capable of efficiently treating bodily malfunctions such as back pain and gastrointestinal weakness by applying a therapeutic massaging treatment along the back and neck of a patient lying down on the massager whose massaging bumps move horizontally and vertically along the patient's spinal cord and neck while the vertical movement of the massaging bumps are actuated by a screw-operated link lifting mechanism.

Conventional bed or mat type massaging devices employ a spring mechanism for vertically moving massaging bumps. As disclosed U.S. Pat. No. 6,454,732, a spring mechanism allows the massaging bumps to gently move up and down. However, when it comes to therapeutic effects, the spring mechanism proves too soft to push up the massaging bumps when stronger pressure is required, because tension of springs applies equally to patients lying on the massaging device regardless of patient's requirements.

A demand is to adopt a reliable mechanism demonstrating a steady and robust therapeutic effects while stabilizing the vertical movement of the massaging bumps.

SUMMARY OF THE INVENTION

The present invention is contrived to overcome the conventional disadvantages. Accordingly, an object of the invention is to provide a lie-down massager that improves therapeutic effects by adopting a screw-operated link lifting mechanism for a vertical movement of massaging bumps.

Another object is to stabilize the vertical movement of the massaging bumps, thereby enabling patients to receive a steady and robust massaging of the massaging bumps applied to and along their backs and necks. A further object is to improve product reliability and customer satisfaction by mechanically stabilizing the vertical movement of the massaging bumps.

To achieve these and other objects, the lie-down massager according to the present invention includes a base frame having an elongated top panel, through which an elongated top opening is formed centrally and lengthwise, a rider provided below the elongated top panel of the base frame, a guide member movably engaged between the base frame and the rider so as to enable the rider to make a horizontally reciprocal movement relative to the base frame, a lifter having a top member, a bottom member, one or more link assemblies, a screw shaft and a lifter motor, a plurality of massage bumps attached on the top member of the lifter and moving vertically and/or horizontally along the elongated top opening of the elongated top panel of the base frame, and a pad covering the massage bumps and the elongated top opening of the base frame.

In the lifter, each of the link assemblies has one or more links and a nut block. The nut block engages with the screw shaft and the lifter motor rotates the screw shaft. The screw shaft is rotatably attached to the bottom member. Each of the links has a top end that is rotatably attached to the top member and a bottom end that is rotatably attached to the nut block. The link assembly moves the top member up and down as the screw shaft is rotated by the lifter motor in either clockwise or counterclockwise direction. The top member is surrounded by the bottom member so that the top member is guided by the bottom member when the top member is moved up and down.

The top member of the lifter has a top plate, a top front wall, a top rear wall, and two top side walls. The two top side walls connect the top front wall and the top rear wall. The top front wall, the top rear wall and the top side walls extend downward from the top plate. The bottom member of the lifter has a bottom plate, and two bottom side walls that extend upward from the bottom plate. Each of the bottom side walls has one or more guide flanges extend perpendicular from the bottom side wall. The top front wall, the top rear wall and the top side walls of the top member are guided by the bottom side walls and guide flanges of the bottom member when the top member is moved up and down by the link assemblies.

The screw shaft is rotatably attached between the two bottom side walls of the bottom member.

The link assembly further has a link shaft rotatably fixed between the top front wall and the top rear wall of the top member. The top ends of the links of the link assembly are rotatably attached to the link shaft.

The nut block has two block ends to which the bottom ends of the links of the link assembly are rotatably attached, and a female thread portion that is provided between the block ends and engages with the screw shaft. The nut block further has two wheels rotatably attached on the block ends. The wheels roll on the bottom plate.

The lifter motor has a worm gear attached thereto, and the screw shaft has a worm wheel attached thereto and engages with the worm gear.

The massage bumps are partitioned to first and second pairs, and the first pair bumps are aligned parallel to the second pair bumps. The massage bump includes a heater that is a heating lamp generating heat and infrared rays.

First and second bump holders are provided for propping and maintaining the first and second pair bumps above the top portion of the lifter. The first and second bump holders are tapered toward each lower end thereof. Also a first engagement member to rockingly engage the lower ends of the bump holders to the top portion of the lifter, and a second engagement member to rollingly engage the massage bumps thereto are provided. The massage bumps are roller balls that are formed of jade.

Alternatively, the massage bumps are provided as round projections that are fixed on the top plate of the lifter.

The guide member includes one or more roller gear engaged to and powered by a roller gear motor, and one or more side rack gears parallel to each other and provided lengthwise in the base frame. The roller gear motor is fixed to the rider, and the roller gears are rollably connected to the rider and rotatably mounted on the side rack gears.

Alternatively, the guide member includes rider guide rollers provided on each side of the rider, and a pair of pulleys linked by a rope and respectively mounted in a front end portion and a rear end portion of the base frame. The rider guide rollers are rollably engaged to the base frame to guide a horizontally reciprocal movement of the rider. A predetermined portion of the rope is fixedly attached to the rider so that the pulley rotation enables the rider to generate a horizontally reciprocal movement of the rider. The pulleys are relatively twisted by 90 degrees against each other.

The lie-down massager further includes a pair of roller coasters parallel to each other, and coaster guide rollers formed outwardly extending from each side of the lifter. The roller coasters are attached to the base frame, and each of the roller coasters has a substantially waved top surface. The coaster guide rollers enable the coasting member to make a roller coasting movement on and along the waved top surfaces of the roller coasters. Each of the waved top surfaces of the roller coasters substantially forms a curvature of a human spinal cord.

The bottom plate of the lifter further includes a plurality of elongated guides extending downward therefrom, and the rider further has a plurality of guide bushes upwardly formed on the rider to releasably receive the elongated guides so as to stabilize the roller coasting movement of the lifter along the roller coasters. The elongated guides are shaped in pins.

Advantages of the present inventions include that: (1) the screw-operated link lifting mechanism minimizes parts required for the vertical movement of the massaging, while improving stability in the vertical reciprocation of the lifter carrying the massaging bumps; (2) the screw-operated link lifting mechanism provides smooth and quite operation of the lifter; and (3) the coasting member working with the roller coasters to realize an additional lifting by utilizing the horizontally reciprocal movement of the rider enables the massaging bumps to continue a smooth, steady and robust massaging on the patient, thereby substantially improving massaging effect and subsequently maximizing customer satisfaction.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
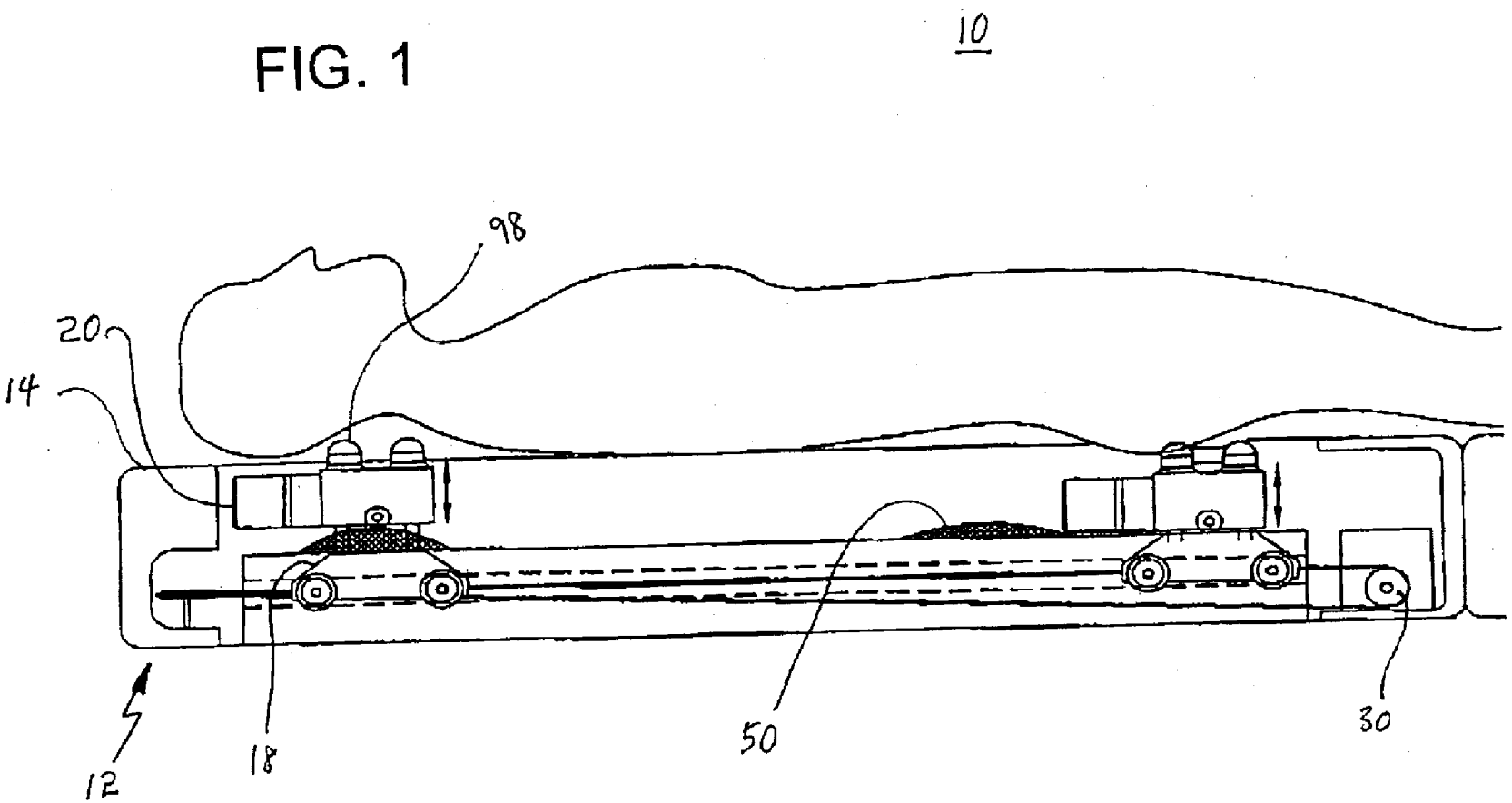
FIG. 1 is a view showing a lie-down massager with a patient lying thereon according to the present invention.
Figure 2:
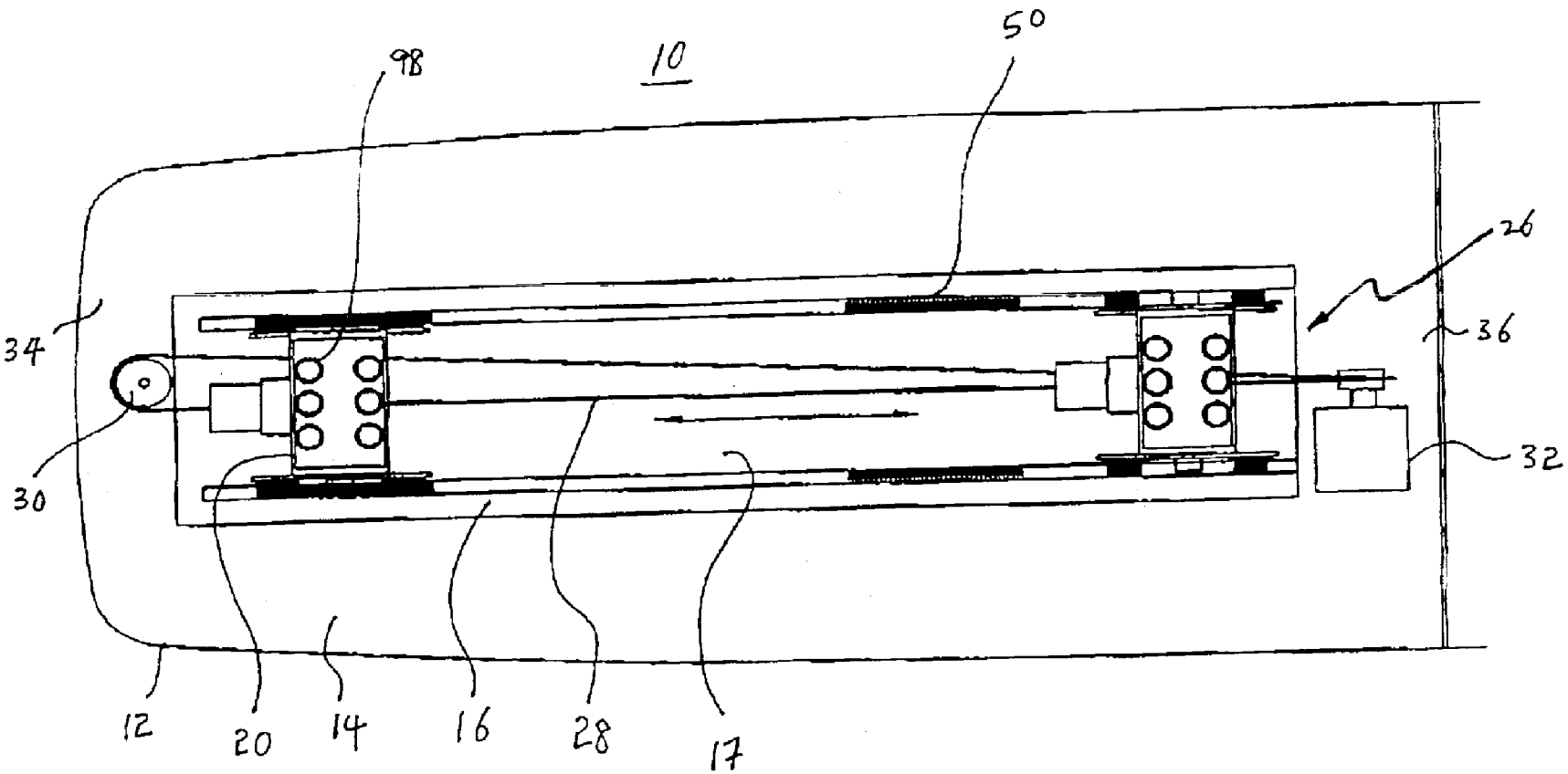
FIG. 2 is a plan view showing the lie-down massager without the patient in FIG. 1.

FIG. 1 shows a brief massaging mechanism of a lie-down massager 10 according to the present invention with a patient lying thereon for a bodily massage, and FIG. 2 shows a plan view of the massager 10 excluding the patient. As shown therein, the lie-down massager 10 includes a base frame 12 in a bed type or a mat type. The base frame 12 includes an elongated top panel 14, and an elongated opening 16 is formed centrally and lengthwise through the elongated top panel 14. The massager 10 includes a rider 18 and a lifter 20. The rider 18 is provided below the elongated top panel 14 of the base frame 12.

In order to implement the horizontal reciprocation of the rider 18, there is provided a guide member 26 movably engaged between the base frame 12 and the rider 18 so as to enable the rider 18 to make a horizontally reciprocal movement relative to the base frame 12. Here, it is recommended that the guide member 26 be either a rope-pulley application or a rack gear application.

Figure 3:
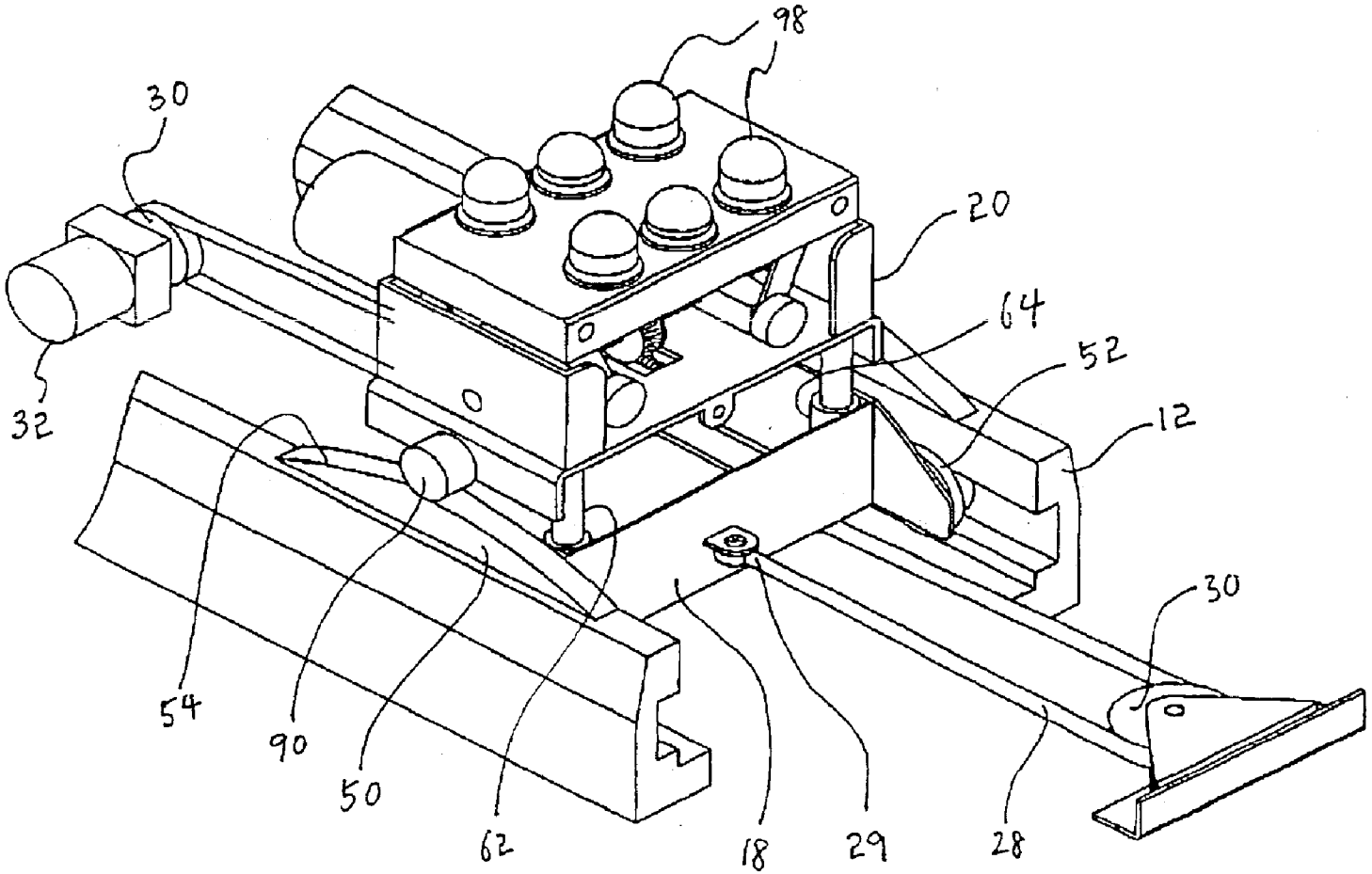
FIG. 3 is a partial perspective view showing an overall mechanism of the lie-down massager according to a first embodiment of the present invention.

As shown in FIG. 2 together with FIG. 3, the guide member 26 according to the rope-pulley application includes a rope 28, a pair of pulleys 30 and a pulley motor 32 that controls one of the pulleys 30. The pulleys 30 are linked by the rope 28 and respectively mounted in a front end portion 34 and a rear end portion 36 of the base frame 12. In a preferred version, the pulley motor 32 is provided adjacent to the pulley 30 provided in the rear end portion 36 of the base frame 12. In this construction, a predetermined portion 29 of the rope 28 is fixedly attached to the rider 18 so that the pulley rotation enables the rider 18 to generate a horizontally reciprocal movement of the rider 18. Preferably, the pulleys 30 are relatively twisted by 90 degrees against each other to facilitate the horizontal reciprocation of the rider 18 while improving controllability of the rider reciprocation.

Figure 4:
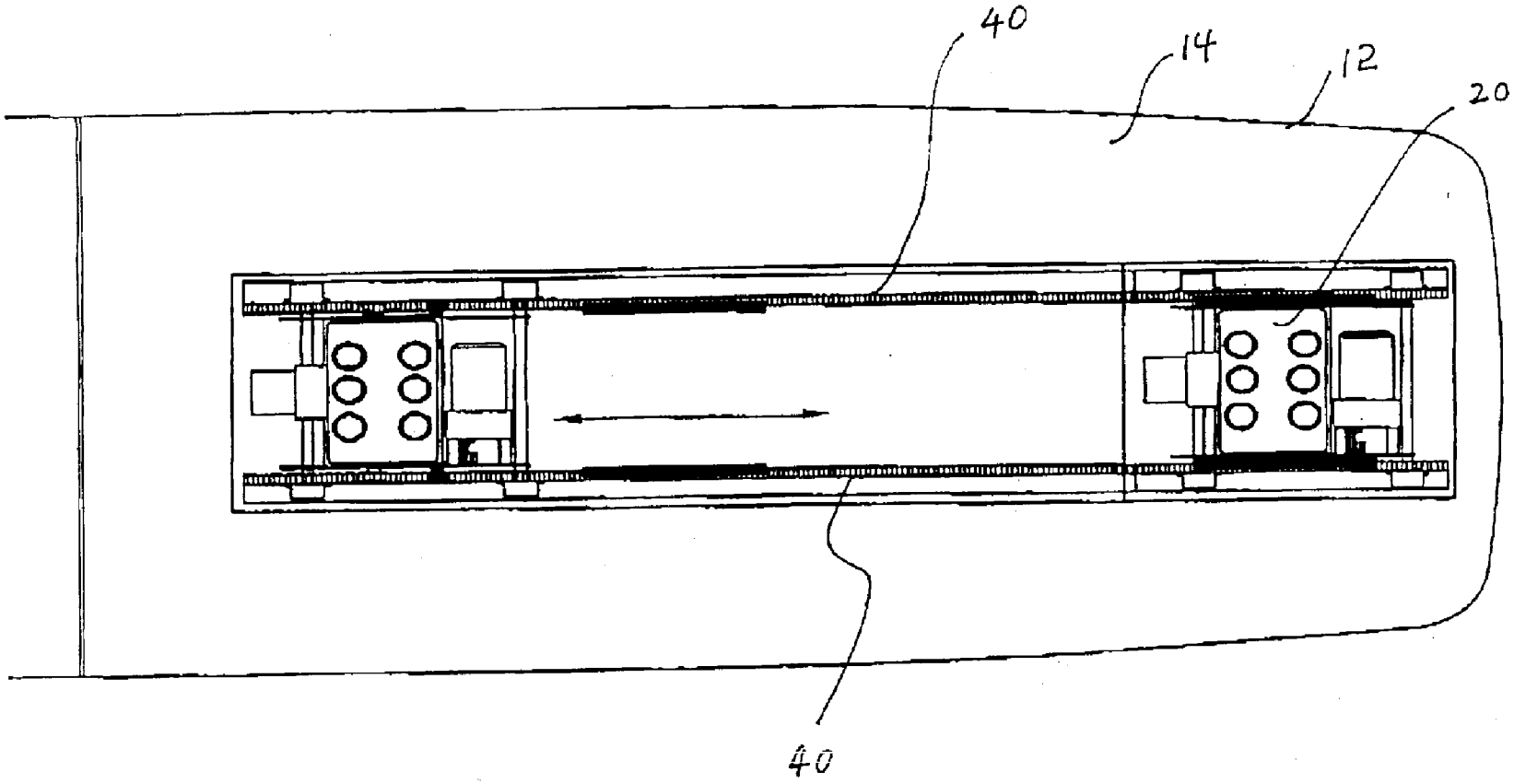
FIG. 4 is a partial plan view showing a second embodiment of the present invention.
Figure 5:
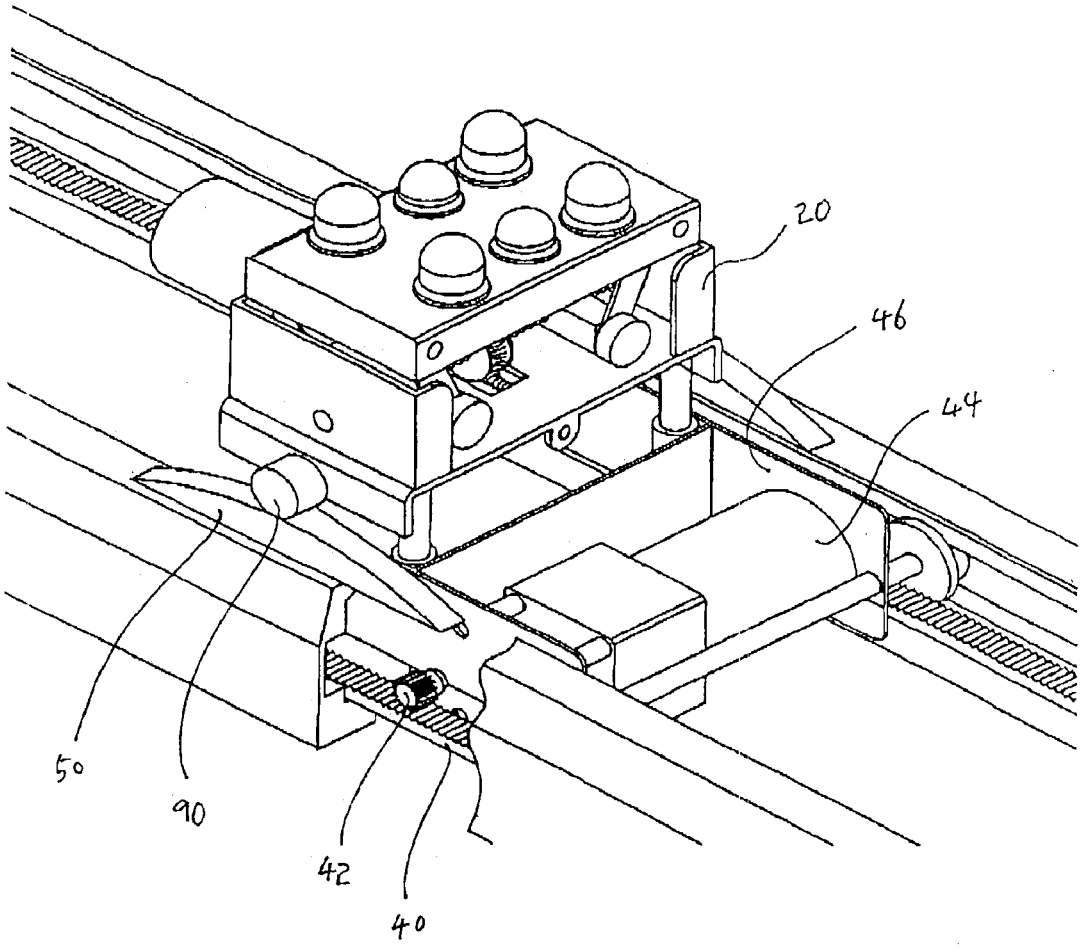
FIG. 5 is a partial perspective view showing the mechanism according to the second embodiment of the present invention.
Figure 6:
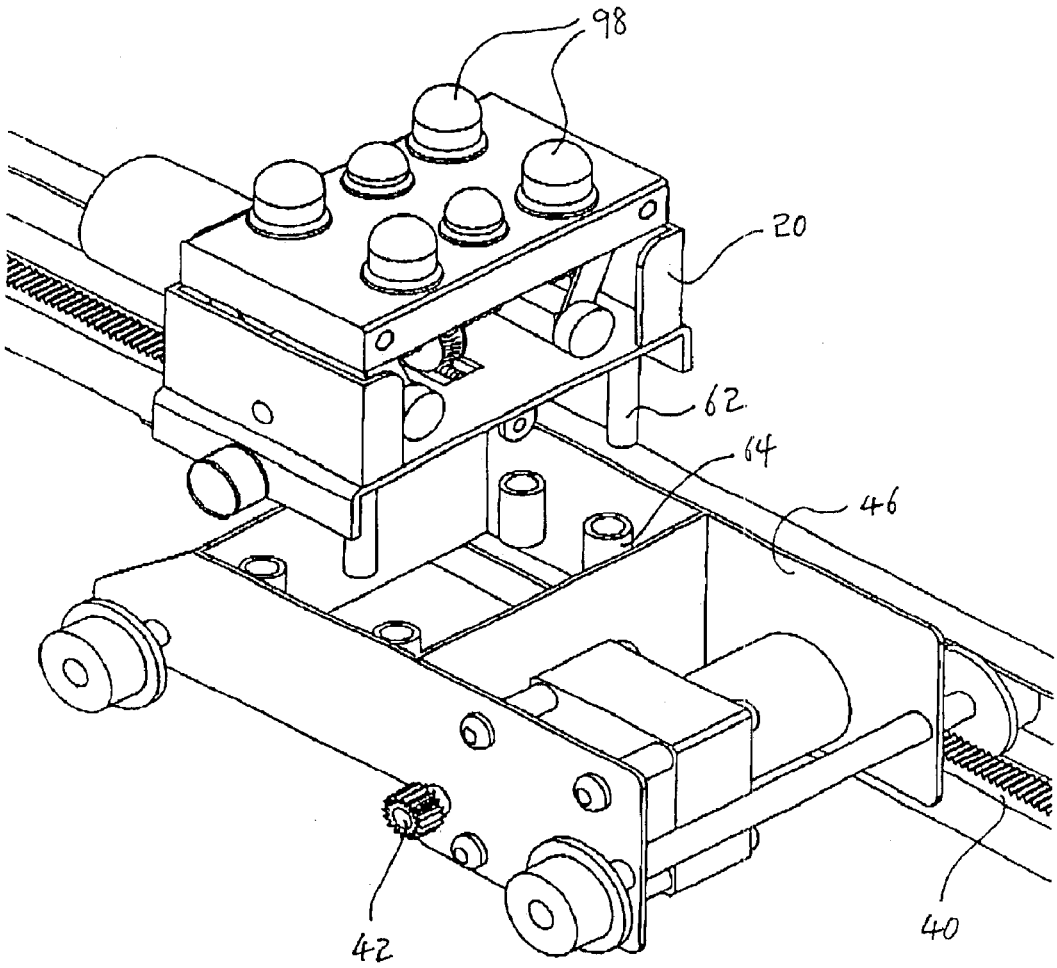
FIG. 6 is a partial exploded perspective view showing the rider and the lifter.
Figure 7:
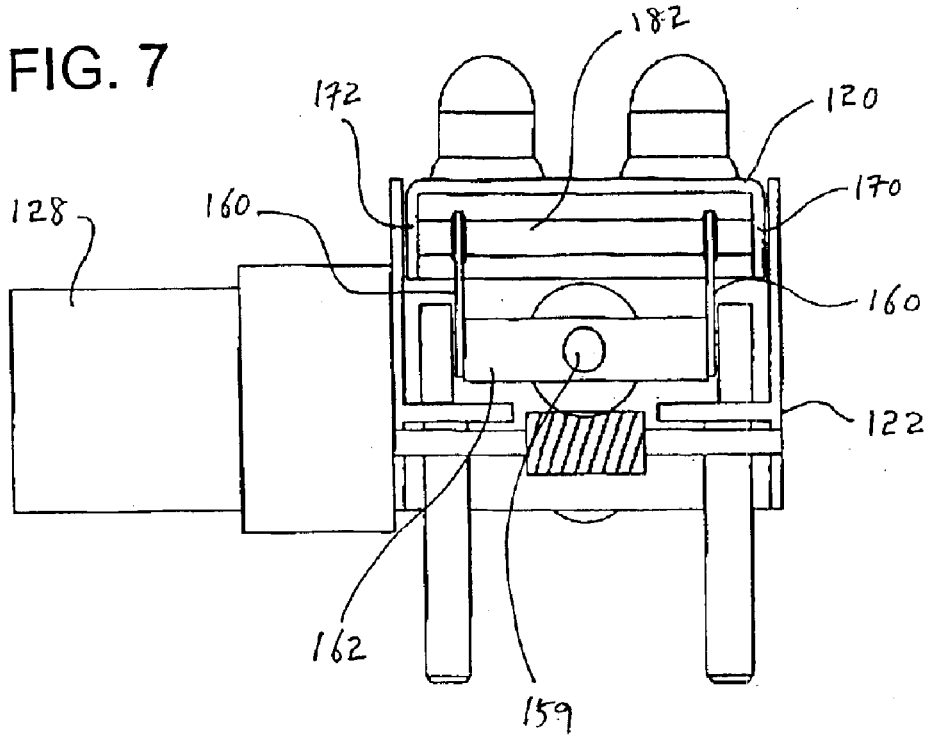
FIG. 7 is a side elevation view of the lifter.
Figure 8:
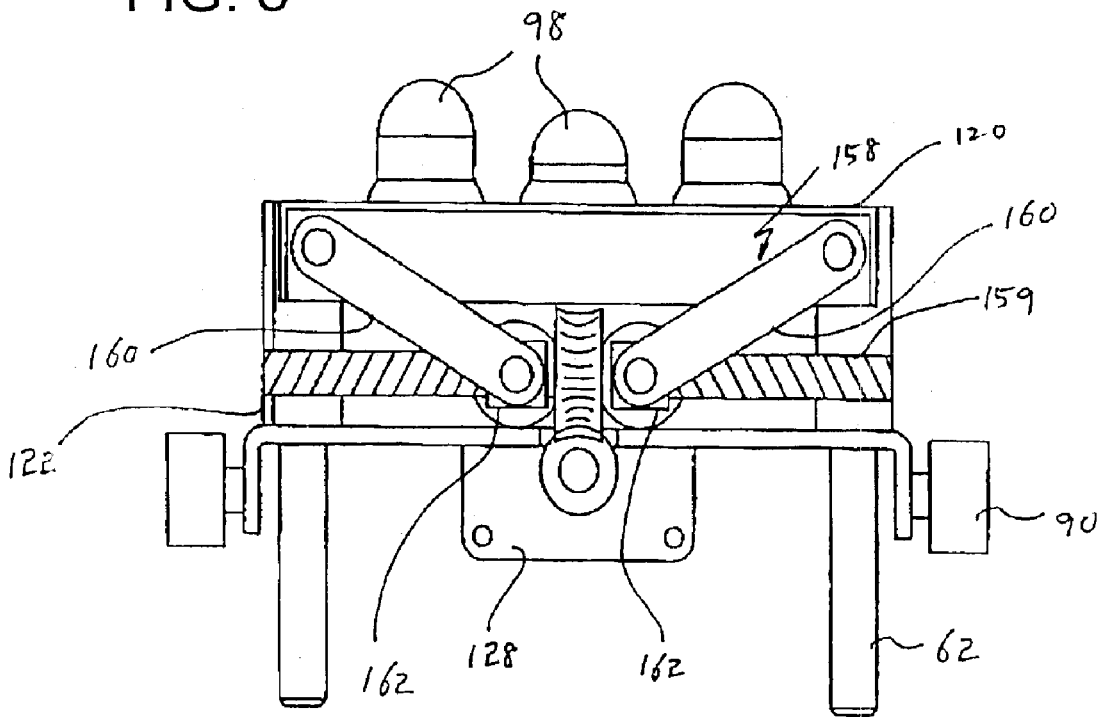
FIG. 8 is a front elevation view of the lifter.

Meanwhile, FIGS. 4, 5 and 6 respectively illustrate the rack gear application for the horizontal reciprocation of the rider 18. As shown therein, the guide member 26 employing the rack gear application includes a pair of side rack gears 40 parallel to each other and lengthwisely provided in the base frame 12, a roller gear 42 perpendicular to the side rack gears 40, and a roller gear motor 44 fixed to the rider to power the roller gear 42. The roller gear 42 is rollably connected to a rider 46 and rotatably mounted on the side rack gears 40.

To accelerate massaging effect, the massager 10 includes one or more pairs of roller coasters 50 parallel to each other. The roller coasters 50 are attached to the base frame 12 and above the rider guide rollers 52 formed on each side of the rider 18 (refer to FIG. 3). The rider guide rollers 52 are rollably engaged to the base frame 12 to guide a horizontally reciprocal movement of the rider 18. That is, the roller coasters 50 are formed on each side of the base frame 12. Here, the roller coasters 50 each have a substantially waved top surface 54. It is preferred that the waved top surfaces 54 of the roller coasters 50 each substantially form a curvature of a human spinal cord.

In order to utilize the roller coasters 50, there are provided two coaster guide rollers 90 formed outwardly extending from each side of the lifter 20. The coaster guide rollers 90 enable the lifter 20 to make a roller coasting movement on and along the waved top surfaces 54 of the roller coasters 50.

As shown in FIGS. 7–14, the lifter 20 has a top member 120 and a bottom member 122, two link assemblies 158, a screw shaft 159 and a lifter motor 128. As is shown well in FIG. 12, each of the link assemblies 158 has two links 160 and a nut block 162. The nut block 162 engages with the screw shaft 159 and the lifter motor 128 rotates the screw shaft 159. The screw shaft 159 is rotatably attached to the bottom member 122. Each of the links 160 has a top end 164 that is rotatably attached to the top member 120 and a bottom end 166 that is rotatably attached to the nut block 162, so that the link assemblies 158 move the top member 120 up and down as the screw shaft 159 is rotated by the lifter motor 128 in either clockwise or counterclockwise direction. The top member 120 is surrounded by the bottom member 122 so that the top member 120 is guided by the bottom member 122 when the top member 120 is moved up and down.

The top member 120 has a top plate 168, a top front wall 170, a top rear wall 172, and two top side walls 174. The two top side walls 174 connect the top front wall 170 and the top rear wall 172. The top front wall 170, the top rear wall 172 and the top side walls 174 extend downward from the top plate 168. The bottom member 122 has a bottom plate 176, and two bottom side walls 178 that extend upward from the bottom plate 176. Each of the bottom side walls 178 has two guide flanges 180 extend perpendicular from the bottom side wall 178. The top front wall 170, the top rear wall 172 and the top side walls 174 of the top member 120 are guided by the bottom side walls 178 and guide flanges 180 of the bottom member 122 when the top member 120 is moved up and down by the link assemblies 158.

The screw shaft 159 is rotatably attached between the two bottom side walls 178 of the bottom member 122.

The link assembly 158 further has a link shaft 182 rotatably fixed between the top front wall 170 and the top rear wall 172 of the top member. The top ends 164 of the links 160 of the link assembly 158 are rotatably attached to the link shaft 182.

The nut block 162 has two block ends 184 to which the bottom ends 166 of the links 160 of the link assembly 158 are rotatably attached, and a female thread portion 186 that is provided between the block ends 166 and engages with the screw shaft 159. The nut block 162 further has two wheels 188 rotatably attached on the block ends 166. The wheels 188 roll on the bottom plate 176.

The lifter motor 128 has a worm gear 190 attached thereto, and the screw shaft has a worm wheel 192 attached thereto and engages with the worm gear 190.

Elongated guides 62 downwardly extend from the bottom plate 176 of the lifter 20, and guide bushes 64 are upwardly formed on the rider 18 to releasably receive the elongated guides 62 so as to stabilize the roller coasting movement of the lifter 20 along the roller coasters 50. Preferably, the elongated guides 62 are shaped in pins.

With the thread engagement between the screw shaft 159 and the nut block 162, and the link 160 transferring the horizontal movement of the nut block 162 into vertical movement of the link shaft 182, and thus of the top member 120, balanced and stabilized lifting and lowering operations of the top member 120 is provided.

Two coasting side walls 156 extend downward from two opposing ends of the bottom plate 176, and the coaster guide rollers 90 are rotatably attached to the coasting side walls 156.

In order to finally apply the screw lifting mechanism to a patient lying on the massager 10, there are provided five massage bumps 98 attached on the top plate 168 of the lifter 20 and moving vertically and/or horizontally along the elongated top opening 16 of the elongated top panel 14 of the base frame 12 (refer to FIG. 3). Optionally, a pad 17 may be provided to cover the massage bumps 98 and the elongated top opening 16 of the base frame 12.

The massage bumps 98 are round projections that are fixed on the top plate 168 of the lifter 20.

Figure 9:
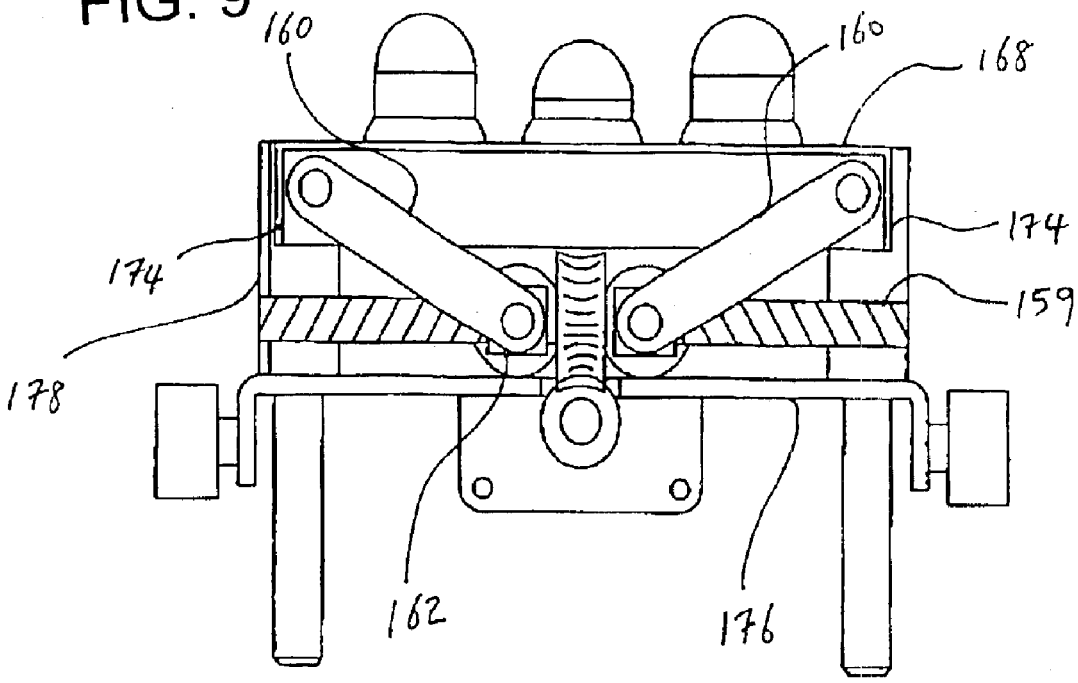
FIG. 9 is a front elevation view showing that the lifter is in its lowest position.
Figure 10:
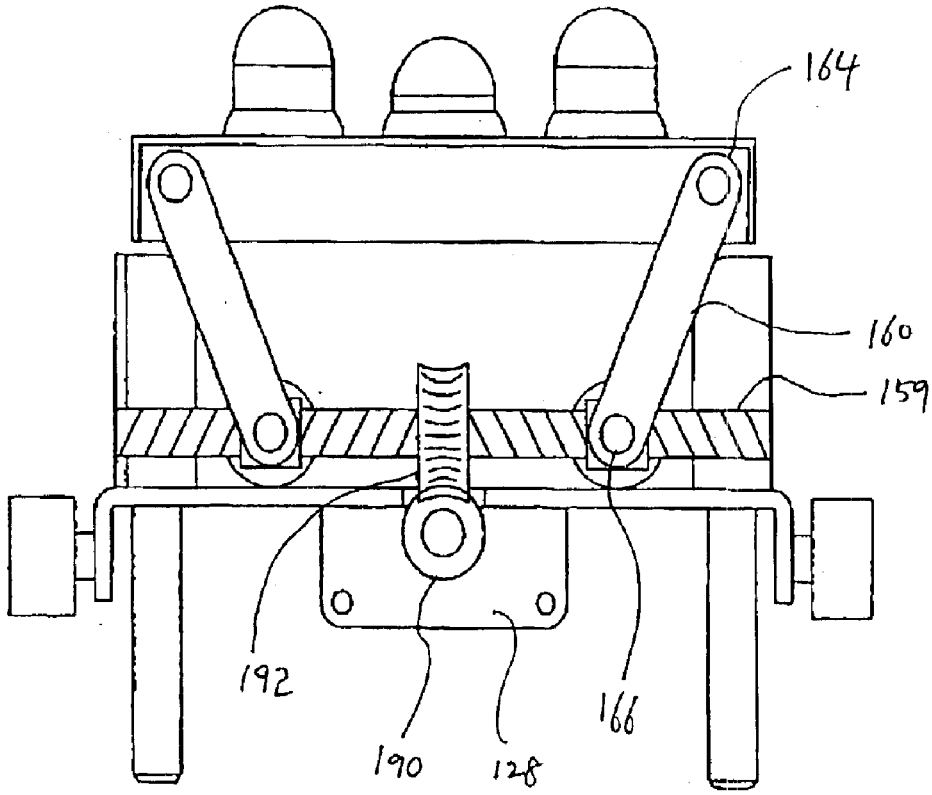
FIG. 10 is a front elevation view showing that the lifter is in its highest position.

FIG. 10 shows that the top member 120 is in its uppermost position, that is, the massage bumps 98 are in their topmost position. FIG. 9 shows that the top member 120 is in its lowermost position, that is, the massage bumps 98 are in their lowermost position.

Figure 11:
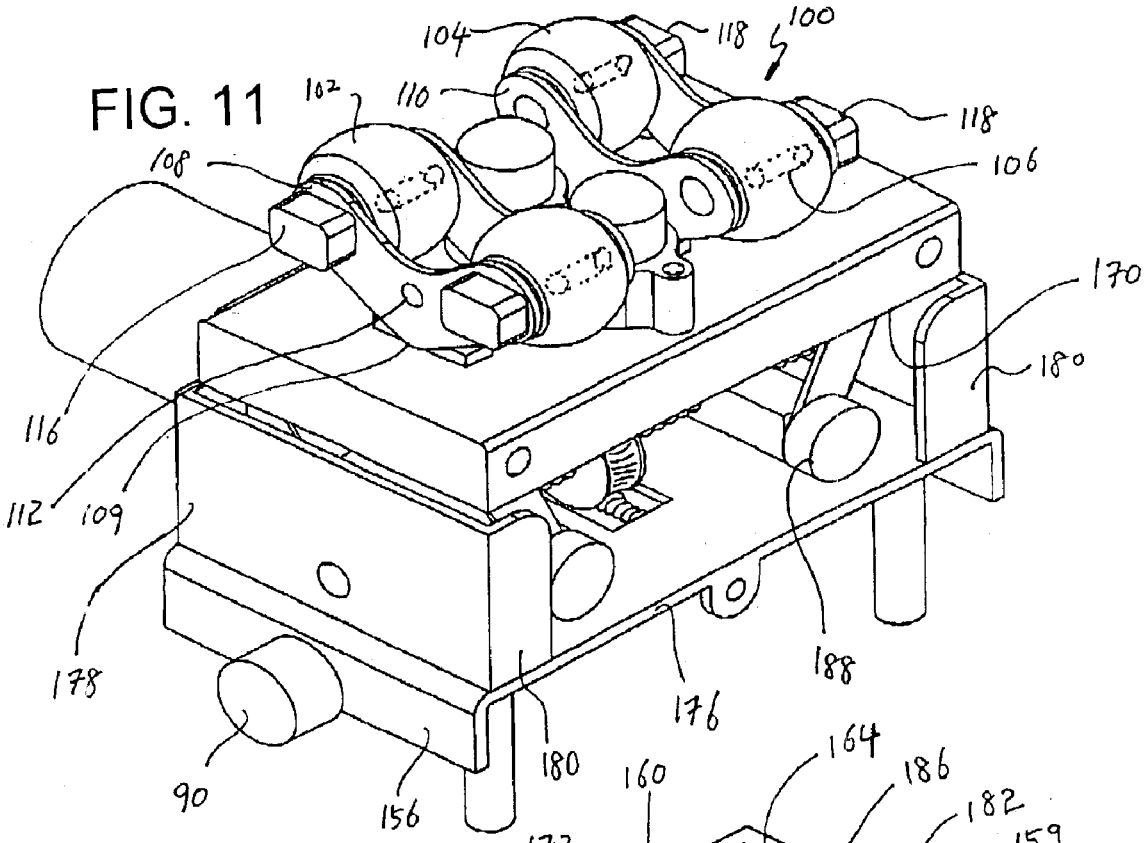
FIG. 11 is a perspective view of the lifter with different massage bumps attached thereon.
Figure 12:
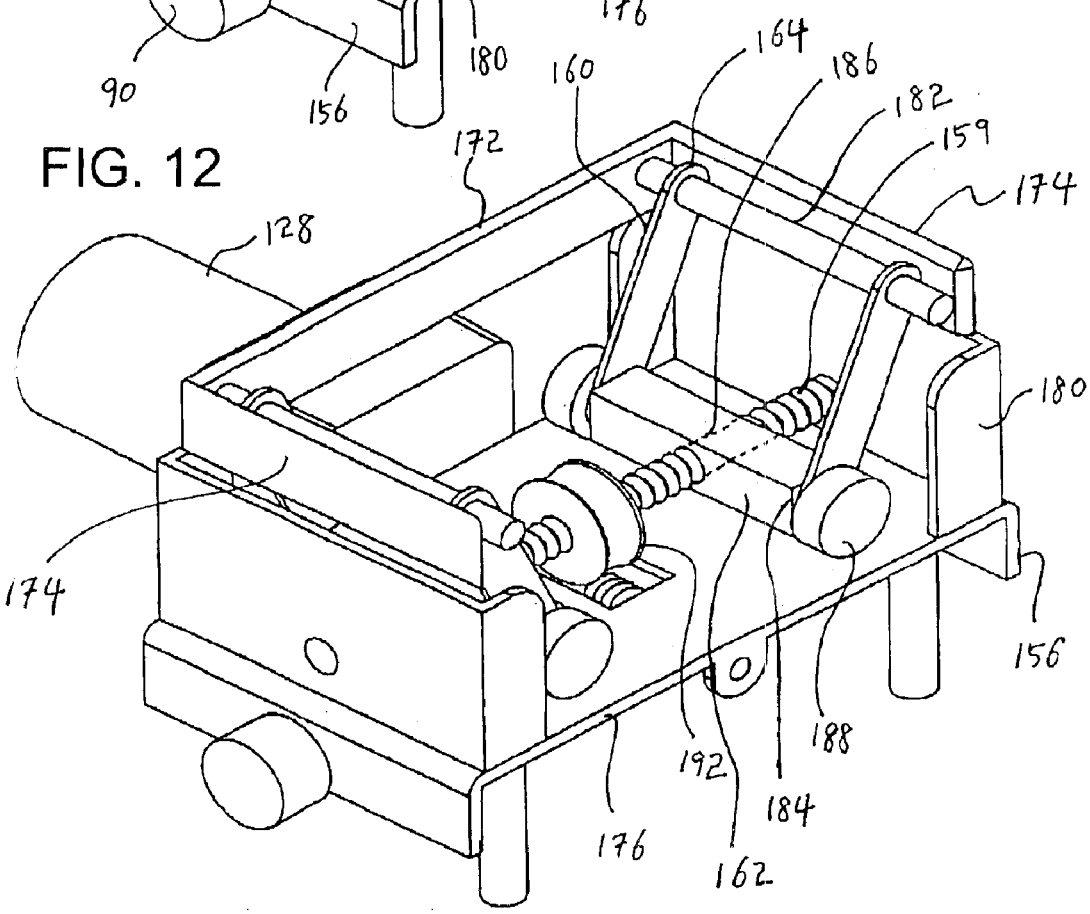
FIG. 12 is a perspective view of the lifter showing the screw-operated link lifting mechanism.
Figure 13:
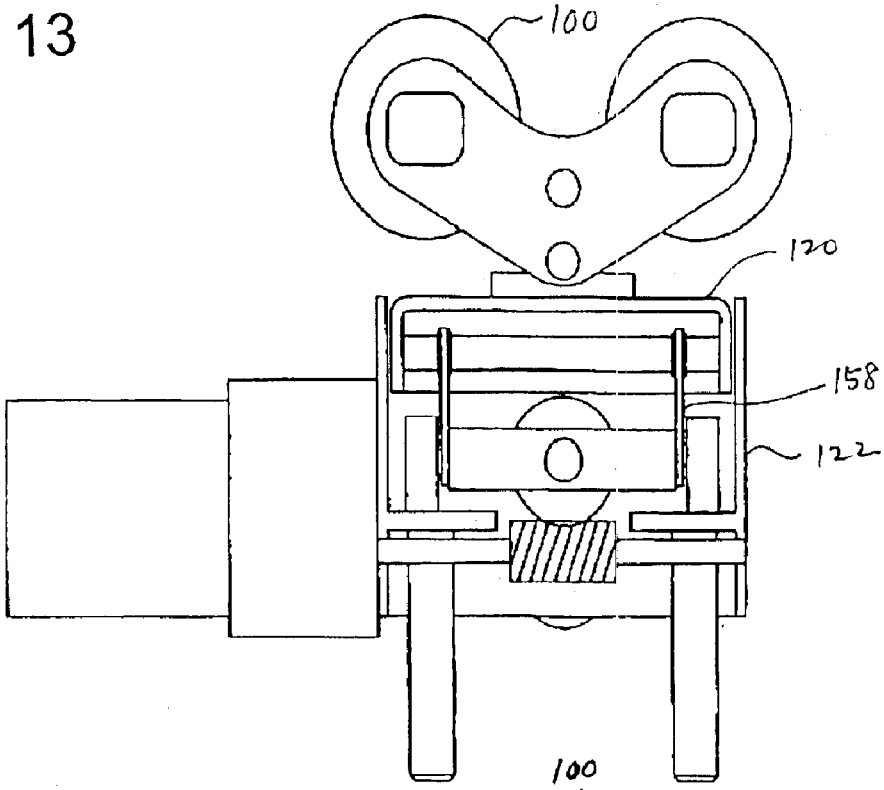
FIG. 13 is a view similar to FIG. 7 but with different massage bumps.
Figure 14:
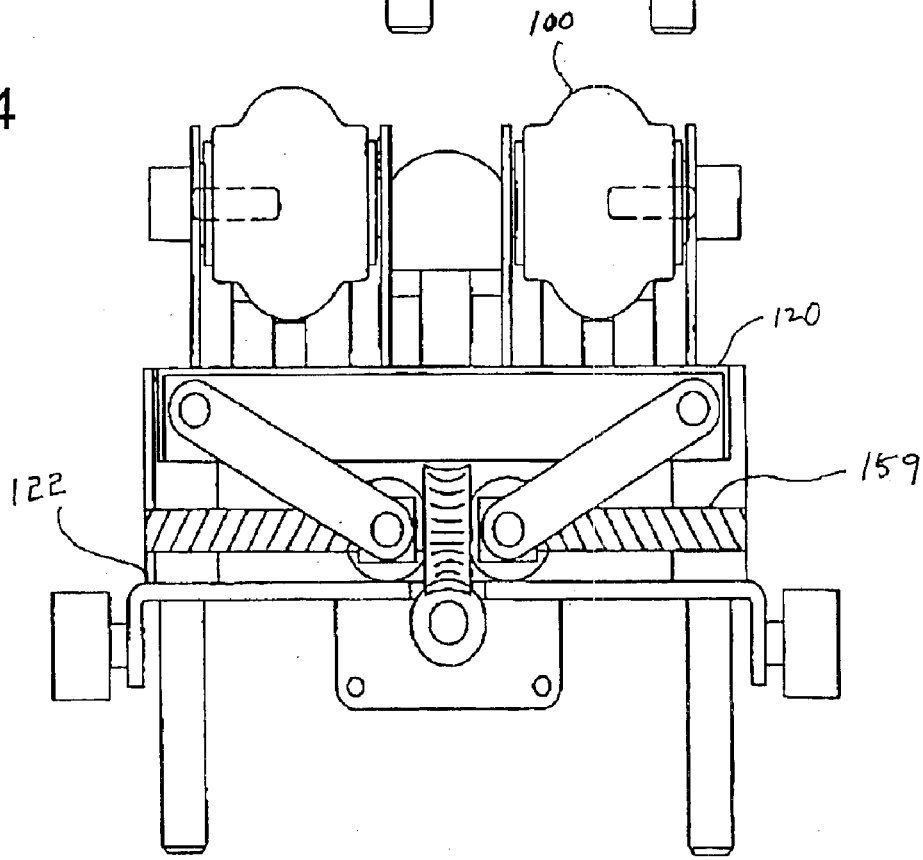
FIG. 14 is a view similar to FIG. 8 but with different massage bumps.

FIGS. 11, 13 and 14 show alternate massage bumps 100. The massage bumps 100 are preferably partitioned to first and second pairs 102, 104. Here, the first pair bumps 102 are aligned parallel to the second pair bumps 104. The massage bumps 100 each include a heater 106 which can be a heating lamp generating heat and infrared rays.

To further improve massaging effect, there are provided first and second bump holders 108, 110 propping and maintaining the first and second pair bumps 102, 104 above the top plate 120 of the lifter 20. For a better massaging result, the first and second bump holders 108, 110 are tapered toward each lower end 109 thereof, and a first engagement member 112 to rockingly engage the lower ends 109 of the bump holders 108, 110 to the top plate 120 of the lifter 20, and a second engagement member 116 to rollingly engage the massage bumps 100 thereto, are provided. The massage bumps 100 may be roller balls formed of precious stone such as jade.

Although the invention has been described in considerable detail, other versions are possible by converting the aforementioned construction. Therefore, the scope of the invention shall not be limited by the specification specified above.

What is claimed is:

1. A lie-down massager, comprising:

a) a base frame having an elongated top panel, wherein an elongated top opening is formed centrally and lengthwise through the elongated top panel;

b) a rider provided below the elongated top panel of the base frame;

c) a guide member movably engaged between the base frame and the rider so as to enable the rider to make a horizontally reciprocal movement relative to the base frame;

d) a lifter comprising a top member and a bottom member, one or more link assemblies, a screw shaft and a lifter motor, wherein each of the link assemblies comprises one or more links and a nut block, wherein the nut block engages with the screw shaft and the lifter motor rotates the screw shaft, wherein the screw shaft is rotatably attached to the bottom member, wherein each of the links comprises a top end that is rotatably attached to the top member and a bottom end that is rotatably attached to the nut block, whereby the link assembly moves the top member up and down as the screw shaft is rotated by the lifter motor in either clockwise or counterclockwise direction, wherein the top member is surrounded by the bottom member so that the top member is guided by the bottom member when the top member is moved up and down, e) massage bumps attached on the top member of the lifter and moving vertically and/or horizontally along the elongated top opening of the elongated top panel of the base frame.

2. The lie-down massager of claim 1 further comprising a pad covering the massage bumps and the elongated top opening of the base frame.

3. The lie-down massager of claim 1 wherein the massage bumps are partitioned to first and second pairs, wherein the first pair bumps are aligned parallel to the second pair bumps.

4. The lie-down massager of claim 3 further comprising:

a) first and second bump holders propping and maintaining the first and second pair bumps above the top member of the lifter, wherein the first and second bump holders are tapered toward each lower end thereof; and b) a first engagement member to rockingly engage the lower ends of the bump holders to the top member of the lifter.

5. The lie-down massager of claim 4 further comprising a second engagement member to rollingly engage the massage bumps thereto.

6. The lie-down massager of claim 4 wherein the massage bumps are roller balls.

7. The lie-down massager of claim 6 wherein the roller balls are formed of jade.

8. The lie-down massager of claim 1 wherein each of the massage bumps includes a heater.

9. The lie-down massager of claim 8 wherein the heater is a heating lamp generating heat and infrared rays.

10. The lie-down massager of claim 1 wherein the guide member comprises:

a) one or more roller gear engaged to and powered by a roller gear motor, wherein the roller gear motor is fixed to the rider; and b) one or more side rack gears parallel to each other and provided lengthwise in the base frame;

wherein the roller gears are rollably connected to the rider and rotatably mounted on the side rack gears.

11. The lie-down massager of claim 1 wherein the guide member comprises:

a) rider guide rollers provided on each side of the rider, wherein the rider guide rollers are rollably engaged to the base frame to guide a horizontally reciprocal movement of the rider;

b) a pair of pulleys linked by a rope and respectively mounted in a front end portion and a rear end portion of the base frame, wherein a predetermined portion of the rope is fixedly attached to the rider so that the pulley rotation enables the rider to generate a horizontally reciprocal movement of the rider.

12. The lie-down massager of claim 11 wherein the pulleys are relatively twisted by 90 degrees against each other.

13. The lie-down massager of claim 1 further comprising:

a) a pair of roller coasters parallel to each other, wherein the roller coasters are attached to the base frame, wherein each of the roller coasters has a substantially waved top surface; and b) coaster guide rollers formed outwardly extending from each side of the lifter, wherein the coaster guide rollers enable the lifter to make a roller coasting movement on and along the waved top surfaces of the roller coasters.

14. The lie-down massager of claim 13 wherein each of the waved top surfaces of the roller coasters substantially forms a curvature of a human spinal cord.

15. The lie-down massager of claim 13 wherein the lifter further comprises a plurality of elongated guides extending downward from the bottom member, and the rider further comprises a plurality of guide bushes upwardly formed on the rider to releasably receive the elongated guides so as to stabilize the roller coasting movement of the lifter along the roller coasters.

16. The lie-down massager of claim 15 wherein the elongated guides are shaped in pins.

17. The lie-down massager of claim 1 wherein the top member comprises a top plate, a top front wall, a top rear wall, and two top side walls, wherein the two top side walls connect the top front wall and the top rear wall, wherein the top front wall, the top rear wall and the top side walls extend downward from the top plate, wherein the bottom member comprises a bottom plate, and two bottom side walls that extend upward from the bottom plate, wherein each of the bottom side walls comprises one or more guide flanges extend perpendicular from the bottom side wall, wherein the top front wall, the top rear wall and the top side walls of the top member are guided by the bottom side walls and guide flanges of the bottom member when the top member is moved up and down by the link assemblies.

18. The lie-down massager of claim 17 wherein the screw shaft is rotatably attached between the two bottom side walls of the bottom member.

19. The lie-down massager of claim 18 wherein the link assembly further comprises a link shaft rotatably fixed between the top front wall and the top rear wall of the top member, wherein the top ends of the links of the link assembly are rotatably attached to the link shaft, wherein the nut block comprises two block ends to which the bottom ends of the links of the link assembly are rotatably attached, and a female thread portion that is provided between the block ends and engages with the screw shaft.

20. The lie-down massager of claim 19 wherein the nut block further comprises two wheels rotatably attached on the block ends, and wherein the wheels roll on the bottom plate.

21. The lie-down massager of claim 19 wherein the lifter motor comprises a worm gear attached thereto, and the screw shaft comprises a worm wheel attached thereto and engages with the worm gear.

* * * * *